United States Patent [19]

Kimbrough et al.

[11] 4,352,226

[45] Oct. 5, 1982

[54] SYSTEM FOR APPLYING AND TENSIONING AN IMPLOSION PROTECTING BAND TO A CRT WITH A TENSION BETWEEN SELECTED LIMITS

[75] Inventors: Laurence B. Kimbrough, Lititz; Leonard P. Wilbur, Lancaster, both of Pa.

[73] Assignee: RCA Corporation, New York, N.Y.

[21] Appl. No.: 200,539

[22] Filed: Oct. 24, 1980

[51] Int. Cl.[3] ..... H01J 9/24

[52] U.S. Cl. ..... 29/25.19; 100/26; 100/32

[58] Field of Search ..... 29/25.13, 25.19; 100/25, 26, 32; 358/246

[56] References Cited

U.S. PATENT DOCUMENTS

| | | | |
|---|---|---|---|
| 3,536,430 | 10/1979 | Kurihara | 100/26 X |
| 3,572,237 | 3/1971 | Kurihara | 100/26 |
| 3,691,939 | 9/1972 | Goodley | 100/26 X |
| 3,697,686 | 10/1972 | Hildebrants | 358/246 |
| 3,777,057 | 12/1973 | Abe | 358/246 |
| 3,851,576 | 12/1974 | Takahashi | 100/33 PB |
| 4,110,877 | 9/1978 | Bracht et al. | 29/25.13 |

FOREIGN PATENT DOCUMENTS

| | | | |
|---|---|---|---|
| 54-98563 | 8/1979 | Japan | 29/25.13 |

*Primary Examiner*—Kenneth J. Ramsey

*Attorney, Agent, or Firm*—Eugene M. Whitacre; Dennis H. Irlbeck; Lester L. Hallacher

[57] ABSTRACT

A system for applying an implosion protecting band to a CRT has a worktable which is slidable with respect to a stationary base. The CRT rests on supports which properly position and locate the CRT with respect to the worktable. At least one of these supports includes pads which center the CRT on the worktable. A channel-shaped segmented band guide loops the band around the CRT. The stationary part of the tension device is affixed to the stationary base. The band feed mechanism and the tensioning mechanism are moveable with respect to the worktable so that the worktable does not deflect in response to the tension.

20 Claims, 4 Drawing Figures

SYSTEM FOR APPLYING AND TENSIONING AN IMPLOSION PROTECTING BAND TO A CRT WITH A TENSION BETWEEN SELECTED LIMITS

BACKGROUND OF THE INVENTION

This invention relates generally to a system for applying a tensioning band to articles and particularly to such a system for applying an implosion protecting band to a cathode ray tube (CRT) with a tension between known limits.

In the operation of a CRT an electron beam travels the length of the tube from an electron gun to a phosphor screen to produce a visual output and accordingly such tubes must be evacuated. Atmospheric pressure, therefore, tends to collapse, or implode, the envelope, creating a potentially hazardous condition. The hazards of implosion can be substantially reduced or eliminated by applying a tension around the envelope in the area between the screen and the seam where the screen and funnel are joined. One common and successful method of implosion protecting a CRT consists of a tensioned metal band which is looped around the envelope at the stress area between the screen and the seam. A metal clip is slipped over the double layered band and the free end firmly held while the other end is pulled into a tension. After the proper tension is applied, such as 1500 pounds (675 kilograms), the clip and both layers of the metal band are crimped, the tensioning device is released and the untensioned free end of the band is cut loose. This technique of applying tension is successful in greatly reducing the hazards of envelope implosion. However, a problem frequently arises because the tension must be within a particular range. Too low a tension will be ineffective in reducing the hazards of implosion and too high a tension will add excessive strain to the envelope, thereby creating a different hazard. Therefore, there is a need for a system which applies the tensioning band with a tension falling within a prescribed range. The instant invention is directed to a system which meets these capabilities.

The tool disclosed in application Ser. No. 200,538 filed of even data herewith by Laurence B. Kimbrough and entitled "HOLDING AND NOTCHING TOOL FOR CRT IMPLOSION PROTECTION" can be used in an embodiment made in accordance with the instant invention.

SUMMARY OF THE INVENTION

A system for applying a tensioning band to an article with a tension having known limits includes a stationary base and a worktable which slides on the base. A plurality of supports position the article on the worktable in a desired orientation and location with respect to the worktable. A portion of the supports also includes means which center the article with respect to the worktable. A segmented channel-shaped band guide loops the band about the article. Band feed means feeds the band about the article and also take slack out of the looped band. Tensioning means applies tension to the band in the same direction that the worktable slides on the base so that the worktable does not deflect under tension.

BRIEF DESCRIPTIONS OF THE DRAWINGS

DETAILED DESCRIPTION OF THE PREFERRED EMBODIMENT

Figure 1:
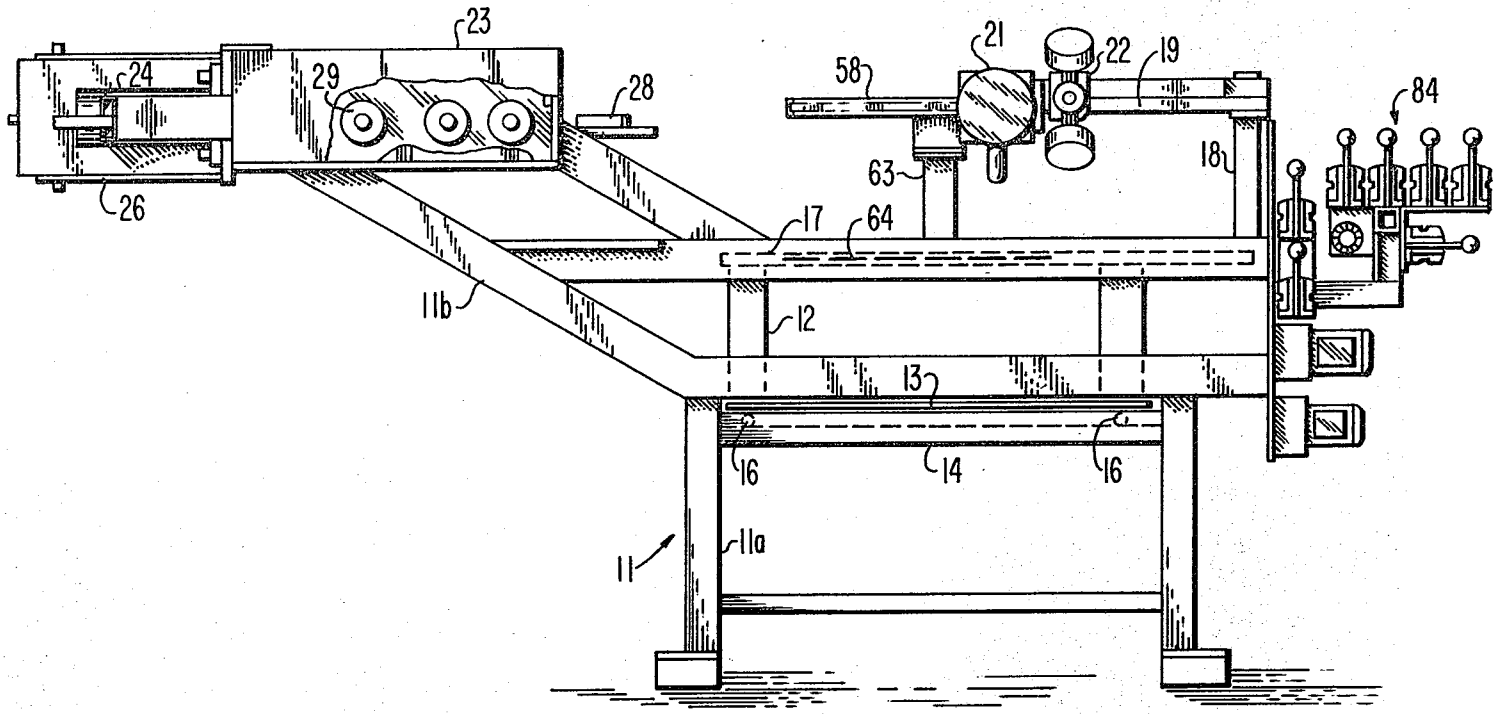
FIG. 1 is a side view of a preferred embodiment of the instant invention.

In FIG. 1, a preferred embodiment includes a stationary base 11 having a lower base portion 11*a* and an integrally attached upper base portion 11*b*. Arranged on a crossbar 14 of the lower base 11*a* is a moveable work table 12 including a base plate 13. A plurality of rollers 16 is arranged between the cross bar 14 and the base plate 13, two of which are shown. The number and size of rollers is determined by the load to be borne and, if desired, rods extending the full depth of the lower base 11*a* can be used. In either event, the rollers permit the worktable 12 to move with respect to the stationary base 11 so that the tension applied to the article being banded does not cause the table to deflect. A spring, or other elastic device, (not shown) returns the worktable 12 to the undeflected position after the tension is removed.

The moveable worktable 12 also includes an upper work surface 17. Integral with the upper base portion 11*b* is a vertical column 18. An arm 19 is rotatably coupled to the top end of the column 18. The arm 19 pivots perpendicular to the longitudinal axis of the column 18 so that the motion of the arm 19 is parallel to the plane of the upper work surface 17. Supported by the arm 19 is a crimping device 21 of known type which is used to crimp a metal clip around two layers of the metal band which is looped around the article being tensioned. The arm 19 also supports a holding device 22 which is used to prevent the free end of the band from moving with respect to the article while the tensioning force is being applied. Preferably this holding device is of the type described in copending application, serial number (RCA 73,351), referenced hereinabove.

Figure 2:
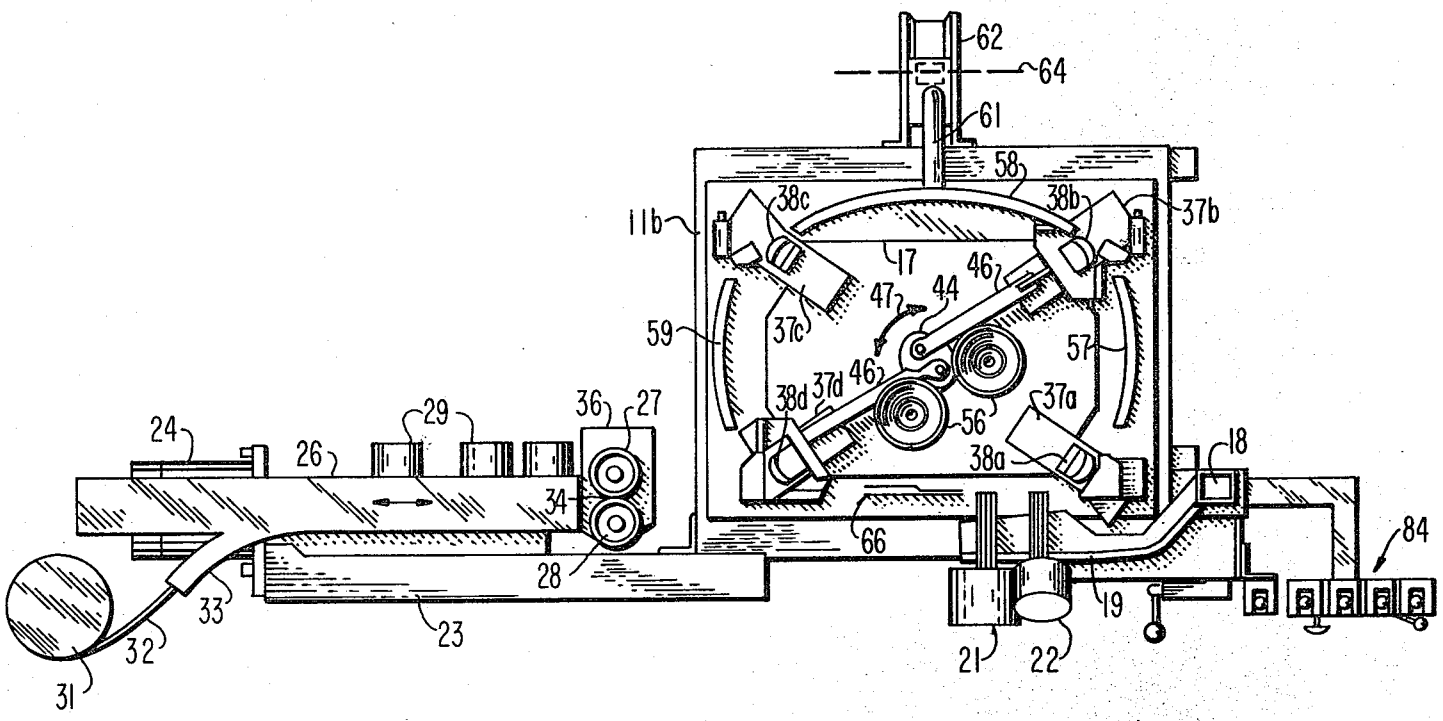
FIG. 2 is a top view of a preferred embodiment of the instant invention.

As shown in FIGS. 1 and 2, a tensioning support 23 is affixed to the end of the upper base 11*b*. A tensioning device 24 is fixedly coupled to the tensioning support 23. In the preferred embodiment illustrated, the tensioning device 24 is an air cylinder having the stationary housing affixed to the support 23. The shaft (not shown) of the cylinder supports to band feed and holding mechanism 26 which includes feed rollers 27 and 28 and a plurality of band holding cylinders 29 which are described in detail hereinafter with respect to FIG. 4. When the actuating fluid is supplied to the cylinder 24, the shaft of the cylinder moves the band feed and holding mechanism 26 with respect to the worktable 12. A roll 31 of banding material is located adjacent an input neck 33 so that a band 32 is fed through the holding mechanism 26 and enters a space 34 between the feed follers 27 and 28. The feed rollers 27 and 28 are mounted on a support 36 in a manner such that the space 34 varies between an opened position and a closed position in which the band is grasped between the feed rollers 27 and 28. Variation of the space 34 can be effected by mounting, one or both, of the feed rollers such that the rotational axis of the roller can be pivoted longitudinally. The band 32 enters the space 34 between the rollers 27 and 28 with the space open and when the space is closed rotation of either or both the feed rollers causes the band to be pulled from the supply roll 31.

The feed rollers 27 or 28 can be rotated by an air motor or an electric motor. Reversal of the rotation causes the slack to be taken out of the band which is looped around the article to be tensioned.

Figure 3:
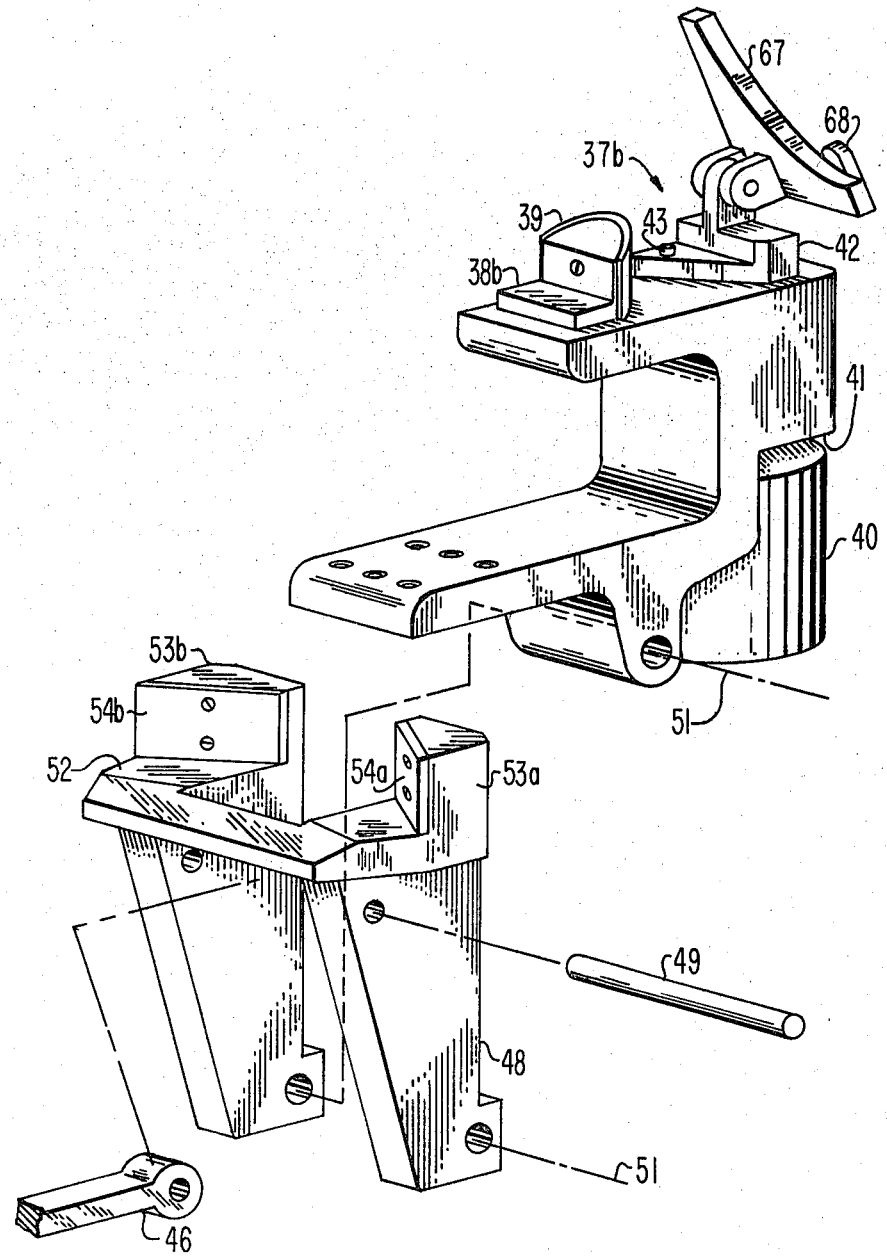
FIG. 3 is an explosed perspective view of the support means and centering means.

Permenantly affixed to the upper support work surface 17 are four corner supports 37*a*, 37*b*, 37*c* and 37*d* arranged at the corners of a rectangle. Affixed to the supports 37*a* through 37*d* are four article positioning pads 38*a*, 38*b*, 38*c*, and 38*d* respectively. As shown in FIG. 3, each of the positioning pads 38*a* through 38*d* contains a positioning surface 39 which slopes downwardly toward the center of the worktable 12. The surfaces 39 are used to locate the article being banded at the proper height above the worktable 12 so that the band is applied at the desired position on the article and also so that the article is oriented level with respect to the worktable 12. As an example, when the article being banded is a CRT, the surfaces 39 are sloped in accordance with the curvature of the screen and the supports 37*a* through 37*d* are dimensioned so that the seam where the screen and funnel are joined is located such that the band is applied between the seam and the screen. The spacing between the corner supports 37 is chosen for a particular article to be banded. Thus, for the implosion protection of a 19 inch (48.26 cm) diagonal color television picture tube, the distance between the diagonally located corner supports 37*b* to 37*d* and 37*a* to 37*c* would be in the order of 19 inches.

The corner supports 37*a* through 37*d* are substantially identical and are attached to the upper work surface 17 by any convenient method such as welding the surface 41 to the surface 17. The vertical distance between the surface 41 and the sloped surface 39 is selected so that the band encircles the CRT at the desired location. Each of the corner supports also includes a mounting block 42 which includes a locating pin 43. Typically, a CRT includes mounting ears which are used to mount the CRT to the metal chassis of the television set. Frequently these ears are held to the envelope by the implosion protecting tensioning band. Accordingly, the height of the mounting block 42 is selected so that the upper surface of the block 42 locates the mounting ears between the envelope and the band. The pins 43 are precisely located so that the ears are properly located with respect to the CRT after the band is tensioned.

The four corner supports 37*a* through 37*d* properly orient the faceplate of the CRT with respect to the worktable 12. However, because the ears must be preisely located on the CRT, the faceplate must be accurately located with respect to the locating pins 43. It therefore also is necessary to center the CRT on the worktable. For this reason the two corner supports 37*b* and 37*d* also include a centering mechanism as shown in FIGS. 2 and 3. In FIG. 2 a shaft 44 is arranged to rotate about an axis which is perpendicular to the plane of the worktable 17. Coupled to the shaft 44 and off center therefrom are two actuating arms 46, so that rotation of the shaft 44 in either direction, as indicated by the arrow 47, moves the arms 46 inwardly and outwardly toward and away from the corner supports 37*b* and 37*d*. As shown in FIG. 3, the arms 46 are coupled to a pivotable pedestal 48 by a rod 49. The rotation of the shaft 44 causes the angle between the longitudinal axes of the arm 46 and the rod 49 to change and therefore the means, such a bearing, which connects the arm 46 and the rod 49 has two degrees of freedom. The rotation of the shaft 44 therefore causes the pedestal 48 to pivot with respect to the corner support 37*b* about an axis 51. The required pivot angle is determined by the dimensions of the system and the rotation of the shaft 44 is constrained to effect the proper pivot angle.

The upper surface 52 of the pivotable pedestal 48 supports two centering pads 53*a* and 53*b*, having centering surfaces which are substantially normal to the surface 52. Affixed to the centering surfaces of the pads 53*a* and 53*b* are article centering faces 54*a* and 54*b*, respectively, which are made of a resilient material to firmly grip the glass CRT screen without scaring or otherwise marring the glass. The centering pads 53*a* and 53*b* are angularly disposed with respect to one another so that the angle between the faces 54*a* and 54*b* is identical to the corner angle of the article to be banded. Thus, for a cathode ray tube being implosion protected, the angle between the faces 54*a* and 54*b* is identical to that between the slightly curved sidewalls of the CRT, i.e. approximately 90 degrees.

The pedestal 48 has an unactuated position in which the surface 52 is tilted away from the plane of the CRT screen about which the band will be looped. In this position, the centering pads 53*a* and 53*b* are spaced from the sides of the CRT. Upon rotation of the shaft 44 in a counter clockwise direction, for the orientation shown in FIG. 2, the pedestal 48 rotates about the axis 51 so that the faces 54*a* and 54*b* of the centering pads are pivoted toward the screen and into contact with the sides of the CRT. The centering action works across the diagonal of the faceplate and therefore all four sides of the CRT are contacted by one of the centering faces and the screen is centered with respect to the worktable 12.

After the centering action is completed a vacuum system (not shown) is actuated and suction cups 56 (FIG. 2) firmly hold the CRT in the desired position while the centering faces 54*a* and 54*b* remain firmly against the sides of the CRT.

As shown in FIG. 2, the system includes a bandguide having a plurality of curved channel-shaped segments 57, 58 and 59. The segments 57, 58 and 59 are arranged so that the channels therein open toward the center of the worktable 12 and are dimensioned such that the cords of the curved sections are shorter than the corresponding dimensions of the CRT screen. Accordingly, spaces remain between adjacent segments in the vicinity of the corners of the CRT. The segment 58 is coupled to a horizontal shaft 61. The shaft 61 is coupled to a rotating device 62 via a vertical shaft 63 so that the segment 58 can be moved away from the proximity of the CRT by pivoting the vertical shaft 63 about the axis 64.

The bandguide also includes a V-shaped band positioner 66 which is longitudinally aligned with the variable space 34 between the feed rollers 27 and 28 so that the band is fed into the wide end of V. The positioner 66 is moveable vertically with respect to the base 11 (for the orientation shown in FIG. 2 inwardly and outwardly from the plane of the paper) and thus also can be is vertically aligned with the space 34.

As shown in FIG. 3, each of the corner supports 37*a* through 37*d* pivotably supports a corner guide segment 67 dimensioned to span the spaces between the segments 57, 58 and 59. A complete loop is thus formed around the CRT by the channel-shaped segments 57, 58, 59, the corner guide segments 67 and the V-shaped positioner 66. The corner guides 67 have an unactuated position shown in FIG. 3, in which the guides are rotated away from the worktable to provide room for inserting and removing the CRT from the worktable. In an actuated position the corner guides 67 are rotated into alignment with the segments 57, 58 and 59 to complete the guide loop around the worktable. Rotation of the corner guides 67 is effected by fluid or electric devices 40 of known type. The band is fed around the table simply by causing the feed roller 27 or 28 (FIG. 2) to rotate clockwise when the space 34 is closed. Each of the corner guides 67 also includes a vertical band positioning pad 68 positioned so that the lower surface of the pad 68 is in alignment with the top of the inside channels of the segments 57, 58 and 59. The top edge of the band rides against this lower surface of the pads 68 and the top surface of the channels of the segments 57, 58 and 59 to prevent the band from rising upwardly away from the worktable.

Figure 4:
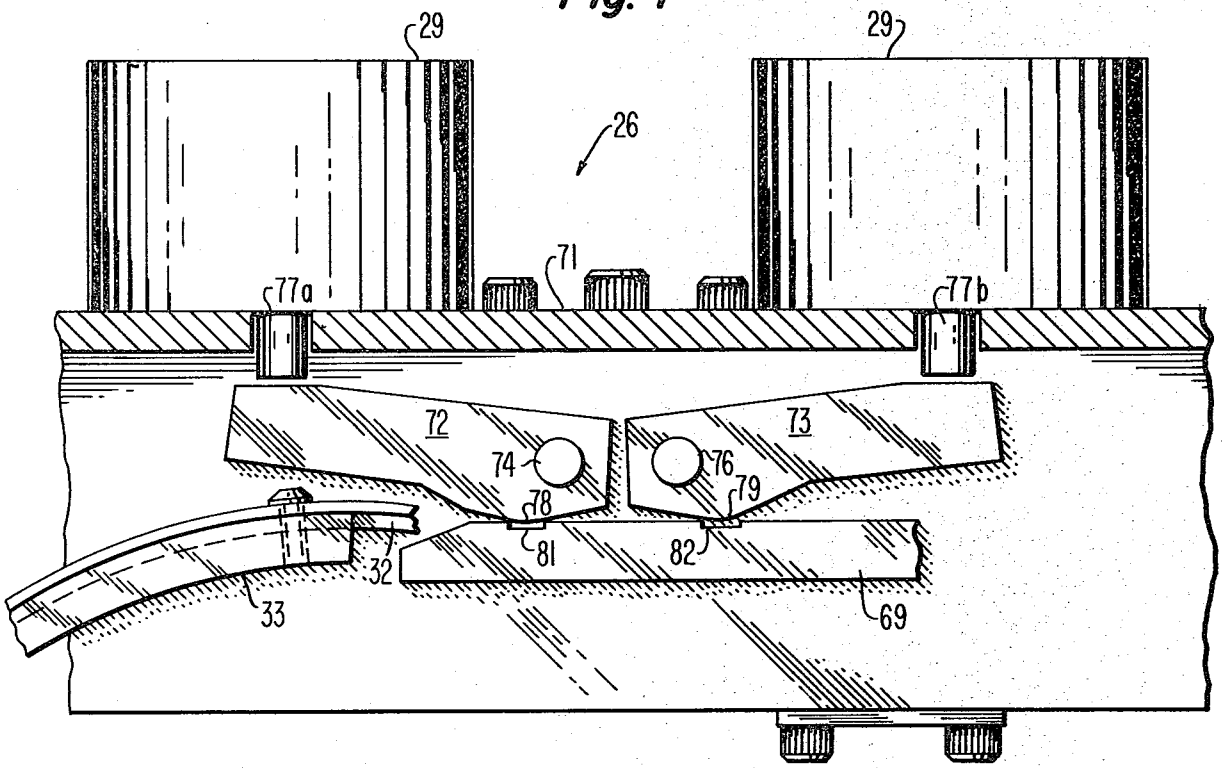
FIG. 4 is a top view partially broken away of the band holding and tensioning mechanism.

FIG. 4 shows the details of the mechanism which holds the band from slipping while tension is being applied. The holding mechanism 26 includes a pressure plate 69 and a side plate 71 parallel to the pressure plate 69. The band 32 is fed into the input neck 33 so that the band slides between the pressure plate 69 and two cams 72 and 73. The cam 72 is arranged to pivot about an axis 74 while the cam 73 pivots about an axis 76. The two cylinders 29 are arranged so that the shafts 77*a* and 77*b* act against the free ends of the cams 72 and 73 respectively. The cam 72 includes an arcuate protrusion 78 and the cam 73 has a similar arcuate protrusion 79. The plate 69 includes two shallow grooves 81 and 82 which are respectively aligned with the protrusions 78 and 79. The band 32 passes between the protrusions 78 and 79 and the grooves 81 and 82. When the band is being fed by the feed rollers 27 and 28 of FIG. 2, the cylinders 29 are unactuated so that the band freely moves between the cams 72 and 73 and the plate 69. When a holding force is to be applied to the band, the shafts 77*a* and 77*b* are pressed against the cams 72 and 73 respectively so that the protrusions 78 and 79 act against the band, forcing the band against the grooves 81 and 82 to firmly hold the band. To tension the band, the cylinder 24 (FIG. 2) is actuated and the entire feed mechanism, which is coupled to the shaft of the cylinder 24, moves toward the left until the desired tension is applied to the band. It should be noted that if desired, more or less than two of the cams 72 and 73 can be utilized depending upon the desired tension.

A control valve assembly 84 is coupled to a fluid source, such as compressed air, and an electrical control circuit is provided to control the various functions. Both the compressed air supply system and the electrical control are within the purview of one skilled in the art and thus the details thereof are not included herein.

To begin operation, the guide segment 58 is in the unactuated position and thus is displaced from the position shown in FIG. 2. The CRT is placed onto the positioning pads 38*a* through 38*d*, either manually or by automatic means, and thus is in substantially the desired position. The centering means is then actuated so that the shaft 44 rotates slightly, pulling the centering pads 54*a* and 54*b* of the diagonally arranged corner supports 37*b* and 37*d* into contact with four sides of the CRT thereby precisely centering the CRT with respect to the worktable 14. The vacuum system is then actuated so that the suction cups 56, in combination with the force applied by the centering pads 54*a* and 54*b*, firmly hold the CRT in the desired position and orientation. Both of these holding forces are maintained throughout the banding operation. The fluid device 62 is actuated to rotate the column 63 about the axis 64 and the segment 58 assumes the position shown in FIG. 2. The V-shaped band positioning means is vertically raised to a height below the frit seal where the faceplate panel of the CRT is attached to the funnel and in alignment with the space 34 between the feed rollers 27 and 28. The corner guides 67 of FIG. 3 are rotated into position to complete the band feed guide around the CRT. The height of the CRT with respect to the segmented band guide is such that the band will be applied between the frit seal and the screen because of the preselected height of the faces 39 of the pads 38*a* through 38*d*. The feed rollers 27 and 28 are moved to close the space 34 so that the two rollers press against the band. The rollers 27 and 28 are then rotated and the band is pulled from the supply roll 31 and fed around the CRT in the band guide formed by the segments 57, 58, 59, the corner segments 67 and the V-shaped positioner 66. The looping of the band around the CRT continues until the band overlaps in the vicinity of the output end of the V-shaped band positioner 66. A clip of known type is then placed over the doubled layered band and the arm 19 is rotated on the column 18 so that the holding device 22 engages the free end of the band in the manner described in the previously cited copending application. The rollers 27 and 28 are then rotated in the reverse direction to pull the band around the CRT and eliminate slack from the band. The fluid cylinders 29 are actuated and the shafts 77*a* and 77*b* (FIG. 4) act against the cams 72 and 73 to firmly hold the band against the notches 81 and 82. The feed rollers 27 and 28 are separated from the band. The fluid cylinder 24 is actuated to pull the entire feed assembly 26 away from the worktable 14 thereby applying the desired tension to the band.

The desired tension in the band can be precisely controlled by properly selecting the area of the piston within cylinder 24 and the air pressure applied thereto. For example, if a tension of 1500 pounds (675 Kilograms) is desired, and the diameter of the piston within the cylinder 24 is 3 inches (7.62 cm), an air pressure of 215 pounds per square inch (15.0 Kilograms/square cm) will be used.

Additionally, the stroke of the piston can be selected to prevent damage to the worktable 14 simply by limiting the stroke to a maximum length. The desired tension is controlled by limiting the pressure supplied to the cylinder with pressure responsive devices of known type so that the band tension is accurately controlled within a range determined by the repeatability of the pressure responsive device. The clip and the double layered band are crimped together and the desired tension is permenently applied to the CRT.

Thereafter, the fluid cylinders 29 are unactuated causing the shafts 77*a* and 77*b* to retract so that pressure is releaved from the cams 72 and 73 thereby releaving the holding force from the band. The end of the band is then cut in the proximity of the clip in any convenient manner and the crimping device 21 and holding device 22 are unactuated and swung away from the band. The corner guides 67 and the guide segment 58 are then returned to their unactuated positions and the vacuum is deenergized so that the suction cups 56 free their grasp on the CRT screen permitting the CRT to be removed.

It should be noted that if a second band is required around the CRT, the entire worktable 12 can be rotated about a shaft having its center coaxial with the axis 44 so that the table rotates 180 degrees and the complete banding process is repeated so that crimped clips are applied on two opposite sides of the CRT.

What is claimed is:

1. A system for applying a tensioning band to an article with a tension between selected limits, comprising: a stationary base and a worktable moveably supported by said base;

a plurality of support means for supporting a article having a generally polygonal cross section on said worktable and for positioning said article in a desired orientation with respect to said worktable, at least a portion of said support means also including means for centering said article with respect to said worktable;

segmented band guide means for guiding said band about said article including a plurality of curved segments having a channel-shaped cross section, said segments being arranged between said support means to guide said band about said article, said guide means also including corner guide segments moveably supported by said support means to guide said band between said curved segments around the corners of said article;

means for feeding said band about said article and for removing slack from said band prior to tensioning said band;

means for applying a known tension to said band, said tension being applied in the same direction as said worktable moves with respect to said base to prevent deflection of said worktable in response to said tension; and means for holding the free end of said band when said slack is being removed and when said tension is being applied.

2. The system of claim 1 further including a plurality of rollers arranged between said worktable and said stationary base so that said worktable slides with respect to said stationary base.

3. The system of claim 2 wherein said curved segments are arranged with the cords of said segments substantially parallel to the sides of said article and wherein said cords are shorter than said sides.

4. The system of claim 3 wherein said corner guide segments are pivotably supported by said support means and further including means for restraining lateral movement of said band so that said band remains aligned with the inside of said channel-shaped segments as said band moves along said corner guide segments between said curved segments.

5. The system of claim 4 further including a V-shaped band positioning means for positioning the end of said band at the desired position with respect to said article prior to said band being fed about said article, said band positioning means being moveable in a direction substantially normal to the plane of said worktable, the wide end of said V-shaped means facing said means for feeding.

6. The system of claim 1 or 5 wherein said means for centering includes at least one pivotable pedestal having a surface angularily displaced from the plane of said worktable in an unactuated position and substantially parallel to the plane of said worktable in an actuated centering position, a plurality of centering pads, including article centering faces substantially normal to said surface and displaced at an angle substantially equal to the angle between adjacent sides of said object so that said faces center said object with respect to said worktable.

7. The system of claim 6 further including coupling means pivotably attached to said pedestal and means for actuating said coupling means to move said pedestal between said unactuated and said actuated positions.

8. The system of claim 7 wherein said support means are arranged to support said article in the proximity of the corners of said article and wherein two of said support means located along a diagonal of said article include said means for centering.

9. The system of claim 8 wherein said means for feeding includes a plurality of rollers with a variable space between said rollers and aligned with said band guide means, and further including means for opening and closing said space so that said band is fed by said rollers when said space is closed and is free to move between said rollers when said space is opened.

10. The system of claim 9 wherein said means for applying tension is a fluid actuated cylinder having a selected diameter and operating in a selected pressure range to establish said tension limits.

11. The system of claim 10 wherein said cylinder is affixed to said stationary base and said means for feeding is coupled to the shaft of said cylinder so that said means for feeding is moveable with respect to said base.

12. The system of claim 11 wherein the stroke of said cylinder is selected to limit the movement of said means for feeding.

13. The system of claim 12 further including means for holding said band when said cylinder applies tension to said band, said means for holding including at least one cam and at least one means for pressing said cam against said band.

14. The system of claim 8 wherein said support means includes means for accurately locating mounting means with respect to said article so that said mounting means are held to said article by said band after said tension is applied.

15. The system of claim 5 wherein said support means includes means for accurately locating mounting means with respect to said article so that said mounting means are held to said article by said band after said tension is applied.

16. The system of claim 1 or 5 wherein said means for feeding includes a plurality of rollers with a variable space between said rollers and aligned with said band guide means, and further including means for opening and closing said space so that said band is fed by said rollers when said space is closed and is free to move between said rollers when said space is opened.

17. The system of claim 16 wherein said means for applying tension is a fluid actuated cylinder having a selected diameter and operating in a selected pressure range to establish said tension limits.

18. The system of claim 17 wherein said cylinder is affixed to said stationary base and said means for feeding is coupled to the shaft of said cylinder so that said means for feeding is moveable with respect to said base.

19. The system of claim 18 wherein the stroke of said cylinder is selected to limit the movement of said means for feeding.

20. The system of claim 19 further including means for holding said band when said cylinder applies tension to said band, said means for holding including at least one cam and at least one means for pressing said cam against said band.

* * * * *